US007997387B2

(12) United States Patent
Rauch et al.

(10) Patent No.: US 7,997,387 B2
(45) Date of Patent: Aug. 16, 2011

(54) PARKING PLATFORM FOR MOTOR VEHICLES

(75) Inventors: Winfried Rauch, Haldenwang (DE); Winfried Schmitt, Bichl (DE)

(73) Assignee: Maha Maschinenbau Haldenwang GmbH & Co. KG, Haldenwang (DE)

( * ) Notice: Subject to any disclaimer, the term of this patent is extended or adjusted under 35 U.S.C. 154(b) by 386 days.

(21) Appl. No.: 12/223,294

(22) PCT Filed: Jan. 30, 2007

(86) PCT No.: PCT/DE2007/000159

§ 371 (c)(1), (2), (4) Date: Aug. 29, 2008

(87) PCT Pub. No.: WO2007/085243

PCT Pub. Date: Aug. 2, 2007

(65) Prior Publication Data

US 2009/0016863 A1 Jan. 15, 2009

(30) Foreign Application Priority Data

Jan. 30, 2006 (DE) ..... 20 2006 001 406 U

(51) Int. Cl.
*B66F 7/02* (2006.01)

(52) U.S. Cl. ..... 187/210; 187/206; 187/207; 187/259; 254/294; 414/239

(58) Field of Classification Search ..... 414/228, 414/239; 187/206, 207, 210, 213, 256, 259; 254/294, 316

See application file for complete search history.

(56) References Cited

U.S. PATENT DOCUMENTS 2,233,055 A 2/1941 Kennedy
2,420,903 A * 5/1947 Noble ..... 182/144
2,857,060 A 10/1958 Carroll (Continued)

FOREIGN PATENT DOCUMENTS

CH 315 981 A 10/1956

(Continued)

*Primary Examiner* — James Keenan
(74) *Attorney, Agent, or Firm* — Oliff & Berridge, PLC

(57) ABSTRACT

The invention relates to a four post parking platform for motor vehicles, comprising two longitudinally directed platform tracks (20, 21) for receiving the vehicle, a front and rear transverse member (5, 6) which both are guided on their ends at the posts (1-4) in a vertically displaceable manner, flexible traction cords (27, 28, 28') which are provided for engaging at the transverse members (5, 6) for raising and lowering the platform tracks and can be wound and unwound on spool bodies (60), a torsionally rigid shaft (19) for connecting the two spool bodies (60) to each other, and with an electrical drive assembly (15) as rotary drive for the two spool bodies (60) and the shaft (19). According to the invention, the drive assembly (15) is mounted to a vertically liftable and lowerable transverse member (6). The shaft (20) is aligned parallel to the platform tracks (20, 21) and rotatably mounted to the two transverse members (5, 6). One end of the flexible traction cord (27, 28) is fixed at the upper end of each post (1-4).

12 Claims, 3 Drawing Sheets

U.S. PATENT DOCUMENTS

| | | | | | |
|---|---|---|---|---|---|
| 3,172,501 | A | * | 3/1965 | Ramer | 187/244 |
| 3,291,260 | A | * | 12/1966 | Woor et al. | 187/209 |
| 3,395,777 | A | * | 8/1968 | Rodosta | 187/213 |
| 3,985,207 | A | * | 10/1976 | Petit | 187/208 |
| 4,023,649 | A | * | 5/1977 | Wood | 187/206 |
| 4,300,659 | A | * | 11/1981 | Silverstrand | 187/213 |
| 4,926,973 | A | * | 5/1990 | Smith | 187/240 |
| 5,098,246 | A | | 3/1992 | Jung | |
| 5,335,755 | A | | 8/1994 | Miller | |
| 6,123,495 | A | * | 9/2000 | Callahan et al. | 414/340 |
| 6,446,757 | B1 | * | 9/2002 | Taylor | 187/208 |
| 7,195,106 | B2 | * | 3/2007 | Heynssens | 187/244 |

FOREIGN PATENT DOCUMENTS

| | | | | |
|---|---|---|---|---|
| DE | 198 12 959 | A1 | | 9/1999 |
| EP | 0 514 613 | B1 | | 10/1997 |
| FR | 1 049 888 | A | | 1/1952 |
| FR | 1 050 578 | | | 2/1952 |
| JP | 52-031443 | A | * | 3/1977 |
| JP | 1-203568 | A | * | 8/1989 |
| JP | A-09-021246 | | | 1/1997 |
| WO | WO 90/08870 | A1 | | 8/1990 |
| WO | WO 98/15489 | A1 | | 4/1998 |
| WO | WO 03/054328 | A1 | | 7/2003 |

* cited by examiner

PARKING PLATFORM FOR MOTOR VEHICLES

BACKGROUND OF THE INVENTION

1. Field of the Invention

The invention relates to a four post parking platform for motor vehicles, comprising two longitudinally directed platform tracks for receiving the vehicle, a front and rear transverse member which connect the platform tracks to each other and are both guided on their ends at the four posts in a vertical manner, flexible traction cords which are provided for engaging at the transverse members for raising and lowering the platform tracks and can be wound and unwound on spool bodies, a torsionally rigid shaft for connecting the two spool bodies to each other, and with an electrical drive assembly as rotary drive for the spool bodies and the shaft.

Generally, such parking platforms are prepared for use in parking lots, particularly in underground car parks and parking garages, to be able to park two vehicles one above the other on the same floor space. For this purpose, the supporting structure consisting of transverse members and longitudinally directed platform tracks is lowered to the floor level, and by using platform-related ramps a vehicle is driven up onto the platform tracks and secured, for example by applying the parking brake or by using other stopping means, e.g. blocks. The platform tracks are lifted via their transverse members together with the supported motor vehicle by starting the drive motor until they reach an upper parking position. The lift distance is dimensioned such that a sufficiently large space is now available for driving a second motor vehicle under the lifted platform.

2. Description of Related Art

FR-PS-1 050 578 discloses a four post parking platform for two lower and two upper cars wherein two transverse members vertically guided at the four posts are raised and lowered by four traction ropes. In total, four longitudinally directed platform tracks are mounted to the two transverse members, which are used to receive two cars. Two respective lateral posts are connected to a U-shaped frame by a horizontal longitudinal rail at their upper ends. A transverse shaft is mounted to the upper end parts of the two front posts, which carries a coiling drum at each end for simultaneously winding and unwinding a front and a rear traction rope, respectively. A drive assembly is mounted to one of the front posts, which makes the two coiling drums rotate synchronously via the common transverse shaft in order to lift or lower the longitudinally directed platform tracks by means of the traction ropes. In this known parking platform the stationary arrangement of the drive assembly at the upper end of one of the posts is considered a drawback. Furthermore, non-uniform lowering and lifting movements of the platform tracks and thus tilted positions of the vehicles supported thereon may result from the different lengths of the used front and rear traction ropes.

U.S. Pat. No. 2,857,060 discloses a parking garage for cars, having lifting units for the vehicles on several floors. These lifting units are mounted to carriages and supporting frames displaceable on horizontal tracks for transporting the vehicles supported thereon in their lowered positions on a floor into one of the stalls. The supporting frames are lifted and lowered via winches and cables driven by motors.

U.S. Pat. No. 2,233,055 describes a parking platform for two cars each, which is preferably used in garages and by means of which two cars may be parked one above the other. A continuous lifting plate guided on hollow profile posts in a liftable and lowerable manner is used to receive a vehicle.

Vertical racks are mounted in the hollow profile posts which engage with rotatingly driven pinions. Two respective pinions are attached to a lateral longitudinal shaft driven on its end by an electric motor.

Finally, a parking garage comprising an integrated lifting platform is disclosed in U.S. Pat. No. 5,335,755. This lifting platform contains two platforms mechanically coupled to each other for receiving two cars. A central motor drives two winch assemblies via transverse shafts, on which a respective traction rope is wound and unwound for lifting and lowering the platform.

BRIEF SUMMARY OF THE INVENTION

It is the object of the invention to provide a parking platform for vehicles which makes it possible to lift, hold and lower the vehicles supported thereon in an operationally safe and uniform manner with little technical effort.

According to the invention this object is obtained by the fact that the drive assembly is mounted to one of the vertically liftable and lowerable transverse members, the shaft arranged parallel to the platform tracks is rotatably mounted to the two transverse members and the traction cords are fixed to the upper end of a respective post.

Since the drive assembly in the inventive parking platform is mounted to one of the transverse members and the longitudinally directed shaft is rotatably mounted to two transverse members, these components accompany the vertical lifting and lowering movements of the platform tracks when the drive assembly is operated.

A particularly safe and stable guidance of the transverse members and thus of the platform tracks mounted thereon is achieved by the fact that posts have a square cross-section and that a guide engaging multilaterally on the related post and a deflection pulley for the elastic traction cord are provided at each end of the transverse members. Advantageously, the guides engaging multilaterally on the related post contain pairs of tapered pulleys running along the outer edges of the square posts.

In order to guarantee secure fixing of the platform tracks in the lifted upper position with or without a car supported thereon, a respective releasable locking mechanism is provided according to a preferred embodiment of the invention at the upper end of each post, which positively locks the transverse member in the raised end position. Advantageously, the locking mechanisms at the respective post may contain rotatably attached shapes on which the transverse members support themselves in the upper parking position by means of a respective support element on their end. In order to release the respective support elements actuators may be provided to rotate the shapes in an electromagnetic, fluidic or mechanic manner.

In the inventive parking platform relatively broad belts made of high-tensile materials, in particular of textile or plastics fabrics, are advantageously used. In general, such belts have an extremely high tensile strength and only a relatively small wall thickness such that the diameter of a winding spool changes at a relatively small degree when a belt is wound and unwound.

A particularly advantageous embodiment of the inventive parking platform is distinguished in that a respective spool body is supported in each of the two transverse members for winding and unwinding one, preferably two belts, the shaft connecting the two spool bodies being disposed inside a hollow platform track and coupled to the drive assembly mounted to the rear transverse member. Due to this arrangement the particularly sensitive components are removed from the influence of the environment, such as mechanical damage or dirt. The drive assembly constituted by an electric motor having a fitted transmission is self-locking and forcibly shut down when the power supply is cut off so that further lowering movements are prevented.

In the inventive parking platform it is essentially important with regard to the required operation safety that an automatically responding security system for monitoring the elastic traction cord for rupture and slack is provided which safely prevents lowering movements of the transverse members, for example when the respective traction cord is ruptured. This security system may have prestressed clamping elements which are mounted to the transverse members and in case of rupture or slack of the related traction cord get into firm clamping engagement with the side wall of the respective post.

In a particularly advantageous embodiment the security system has rockers pivotably supported on a trunnion between the lateral bridges of the transverse members and between which the respective deflection pulley for the traction cord is mounted. These rockers have cam surfaces optionally provided with a friction lining which in case of rupture or slack of the traction cord get into clamping engagement with the side wall by a pivoting movement of the rocker.

In another four post parking platform according to the invention the drive assembly consisting of an electric motor and a fitted transmission is mounted to the upper end of a post. An upper longitudinally extended shaft connects the upper ends of the two posts of a longitudinal side. In each post and on the inside of the transverse rails traction cords such as link chains, traction ropes or the like are disposed which are wound or unwound on winches by a rotary movement of the shaft.

Advantageously, in the parking platforms constituted according to the invention posts, platform tracks, and Transverse rails are used which are manufactured by reforming, in particular bending, and welding them into hollow profiles having respective suitable rounded or angular cross-sections. The posts, Transverse rails, platform tracks and other components of the lifting platform may advantageously also be made as aluminum molds which means a simplified and inexpensive manufacture as well as lesser self-weight. Particularly, the posts, Transverse rails and platform tracks may be open or closed hollow profiles of suitable cross-sectional dimensions manufactured in special facilities by extrusion molding. The hollow profiles are acquired as half-finished products by press plants and processed further by a few simple operations.

BRIEF DESCRIPTION OF THE SEVERAL VIEWS OF THE DRAWINGS

In the following an embodiment of the inventive parking platform will be described in detail with reference to the drawings, wherein.

DETAILED DESCRIPTION OF THE INVENTION

Figures 1, 1A:
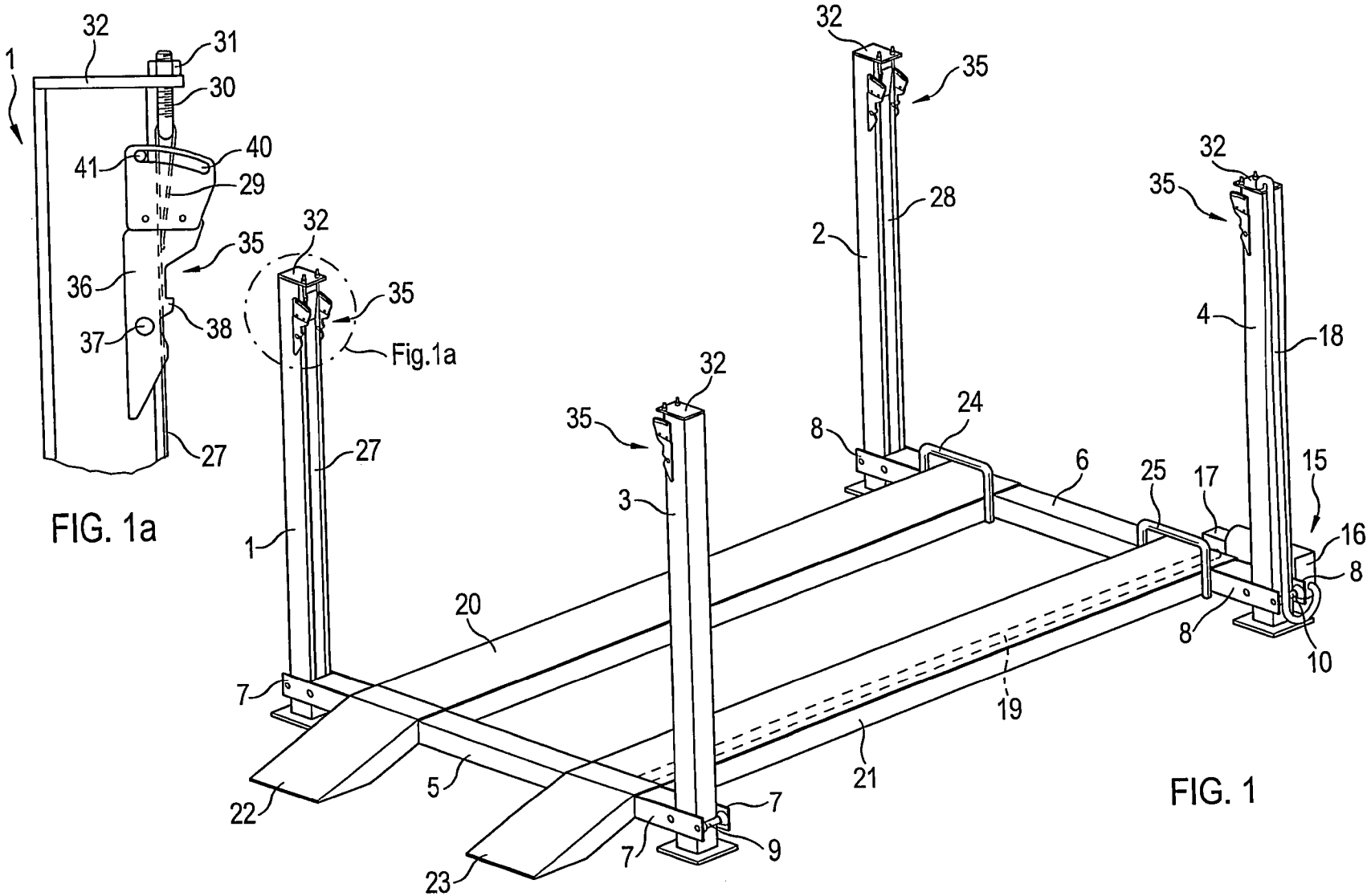
FIG. 1 shows schematic overall view of a four post parking platform.
FIG. 1*a* shows a schematic side view of an upper end of a post.

The parking platform shown in FIG. 1 contains four vertical posts 1 to 4 consisting of dimensionally rigid square hollow profiles. At the two front posts 1, 3 and the two rear posts 2, 4 a respective transverse member 5, 6 is guided in a vertically displaceable manner. In the area between the related posts the transverse members 5, 6 have a rectangular square profile. At both ends of each transverse member 5, 6 two tabs 7, 8 are provided which extend parallel to the planar side walls of the related square post. The end parts of the tab pairs extending beyond the post profile are linked to each other via a rear bolt 9, 10. As can be taken from FIG. 2 in particular, two respective tapered pulleys 11, 12 are disposed on each of the bolts 9, 10, which represent guiding elements for the lifting and lowering movements of the transverse members 5, 6 and which run with their conical circumferential surface on the rounded rear corner edges of the respective post 1 to 4.

A drive assembly 15 having an electric motor 16 as well as a transmission 17 connected thereto is mounted to the rear side of the rear transverse member 6 of FIG. 1. A pipe 18 having upper and lower deflections is mounted to the post 4 in which among others the cables for the energy supply of the electric motor 16 are arranged and protected against dirt and mechanical stress. The transmission 17 drives a shaft 19 shown by dashes in FIG. 1 which is rotatably mounted to the ends in suitable mounting arrangements in both transverse members 5, 6.

Two platform tracks 20, 21 formed in a flat square cross-section are used as receivers for a motor vehicle to be lifted. At the front ends of the two platform tracks 20, 21 hinged ramps 22, 23 may optionally be provided. The front end parts of the two platform tracks 20, 21 are attached to the front transverse member 5 and the two rear end parts of the two platform tracks 20, 21 are attached to the rear transverse member 6. Two dimensionally rigid clamps 24, 25 extend beyond the surface of the two platform tracks 20, 21 in the range of the rear transverse member 6 and are used as end stops for a received vehicle.

In the embodiment as shown the transverse members 5, 6, together with the platform tracks 20, 21, the drive assembly 15 and the shaft 19, form an assembly which is approximately frame-shaped and performs lifting and lowering movements guided together in a vertical manner at the posts 1 to 5. This assembly is suspended from elastic traction cords which in the present embodiment are formed as high-tensile flat belts 27, 28 from a special textile or plastics material. A flat belt 27, 28 respectively extends on the respective inner side of each post 1 to 4. The upper end of each flat belt 27, 28 is formed as a noose 29 (cf. FIG. 1*a*) and fixed to a U-shaped clamp 30 both vertical legs of which are attached to an end plate 32 of the respective post via a respective nut 31. This attachment of the upper ends of the respective flat belts 27, 28 makes it possible to adjust and readjust the respective belt length.

In order to secure the upper end position of the two platform tracks 20, 21 with their transverse members 5, 6 separate locking mechanisms are provided for each post which make it possible to releasably fix the transverse members 5, 6 in their upper lifted parking position and to safely prevent an accidental lowering of the entire assembly with or without the vehicle supported thereon. Additionally to the self-locking function of the drive assembly 15 the function of the locking mechanisms guarantees sufficient operational safety against random lowering movements. The respective locking mechanisms 35 each contain a profile plate 36 which is rotatably mounted to the respective post 1 via a bolt 37 and has a tooth-shaped projection 38. This projection 38 is used as a support for a plate 39 shown in FIG. 3 and attached to the upper rail of the respective transverse member 5, 6. As can be taken further from FIG. 1*a*, the rotatable profile plate 36 shows a circular-arc shaped long slot 40 in its upper portion wherein a pin 41 fixed to the post is guided. The length and shape of the long slot 40 indicate the magnitude of the rotating movements of the profile plate 36.

Figure 2:
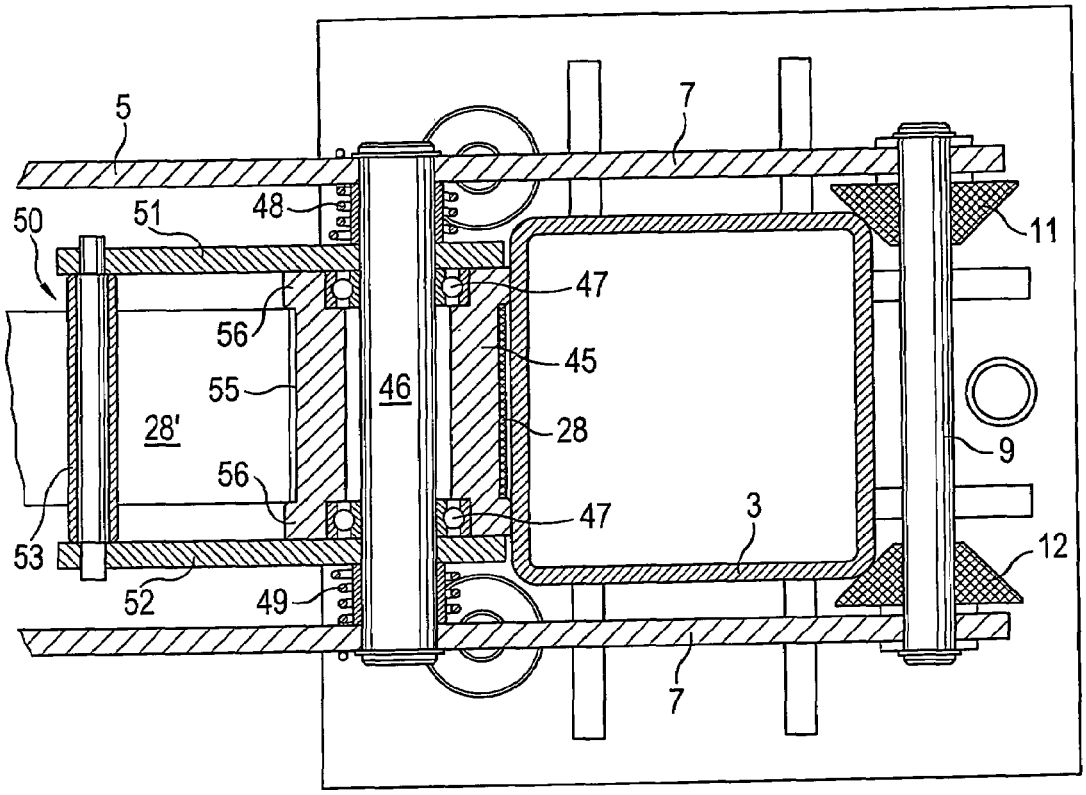
FIG. 2 shows a cross-section of a post with the guide of a transverse member and the deflection support of a traction cord.

FIG. 2 shows the cross-section of the post 3 consisting of a one-piece square profile. The transverse member 5 is guided at the outer wall of the post 3 by means of the two extension tabs 7 and the rear tapered pulleys 11, 12. At the front outer wall of the post 3 runs a deflection pulley 45 mounted to a bolt 46 in two antifriction bearings 47 in a freely rotatable manner. With its two ends the bolt 46 is placed in a respective one of the lateral extension tabs 7 of the transverse member 5. Furthermore, two springs 48, 49 are disposed on the bolt 46, respectively, via a corresponding sleeve. Moreover, a rocker 50 consisting of two plates 51, 52 is arranged at this bolt 46. The tapering end parts (see FIG. 3) of these two parallel plates 51, 52 are connected to each other by an encased transverse bolt 53. The end part of the two plates 51, 52 of the rocker 50 on the right in FIGS. 2, 3 has a cam shape 54 suggested in FIG. 3.

As can be taken from FIG. 2 the deflection pulley 45 has a recess 55 in its center portion in which a flat belt 27 is received. This recess is defined by two lateral ring-profiled portions 56.

The security system described above reliably prevents an accidental lowering of a transverse member when the related flat belt turns slack or ruptures. Under normal operating conditions shown in FIG. 3 the encased connecting bolt 53 of the rocker 50 is pushed upwards against the force of the springs 48 by resting on the firmly tightened flat belt 27 such that the cam part 54 cannot get into action. As soon as slack or a tear occur in the flat belt 28 the rocker 50 pivots about the trunnion 46 by the force of the torsion springs 48 such that the cam 54 comes into clamping engagement with the outer wall of the post 3 and thus prevents a further lowering movement of the transverse member.

Figure 3:
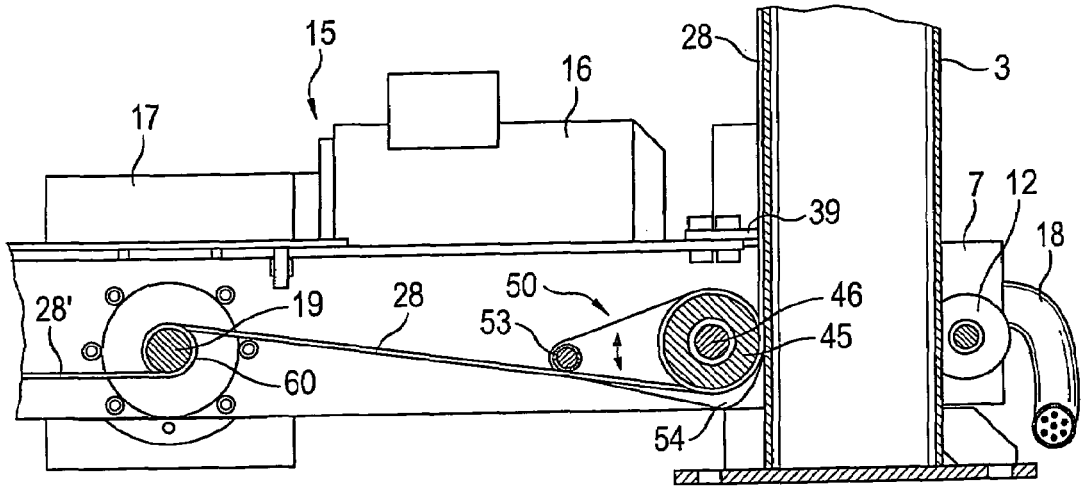
FIG. 3 shows the longitudinal section of the lower part of a post with a transverse member guided alongside thereof.

As can be taken from FIG. 3 the shaft 19 is provided with spool bodies 60 on its ends which are formed such that two traction cords 28, 28' may synchronously be wound on one spool body 60. The shaft 19 as well as the spool body 60 are located and protected inside the transverse members and the one platform track 20, respectively. By rotating the shaft 19 by means of the drive assembly 15 two front and two rear flat belts will be wound or unwound synchronously, resulting in a uniform lifting or lowering movement of the respective transverse member and thus of the platform tracks mounted thereon. A particular advantage is the fact that the flat belts are of a very short length so that material strains do not play a part in practice.

In the following the embodiment of the invention shown in FIG. 4 will be described which corresponds to the four post platform described above with reference to FIG. 1 as regards the essential features and measures. Accordingly, components having the same structure or function are denoted by the same reference numerals and their description will not be repeated.

Figure 4:
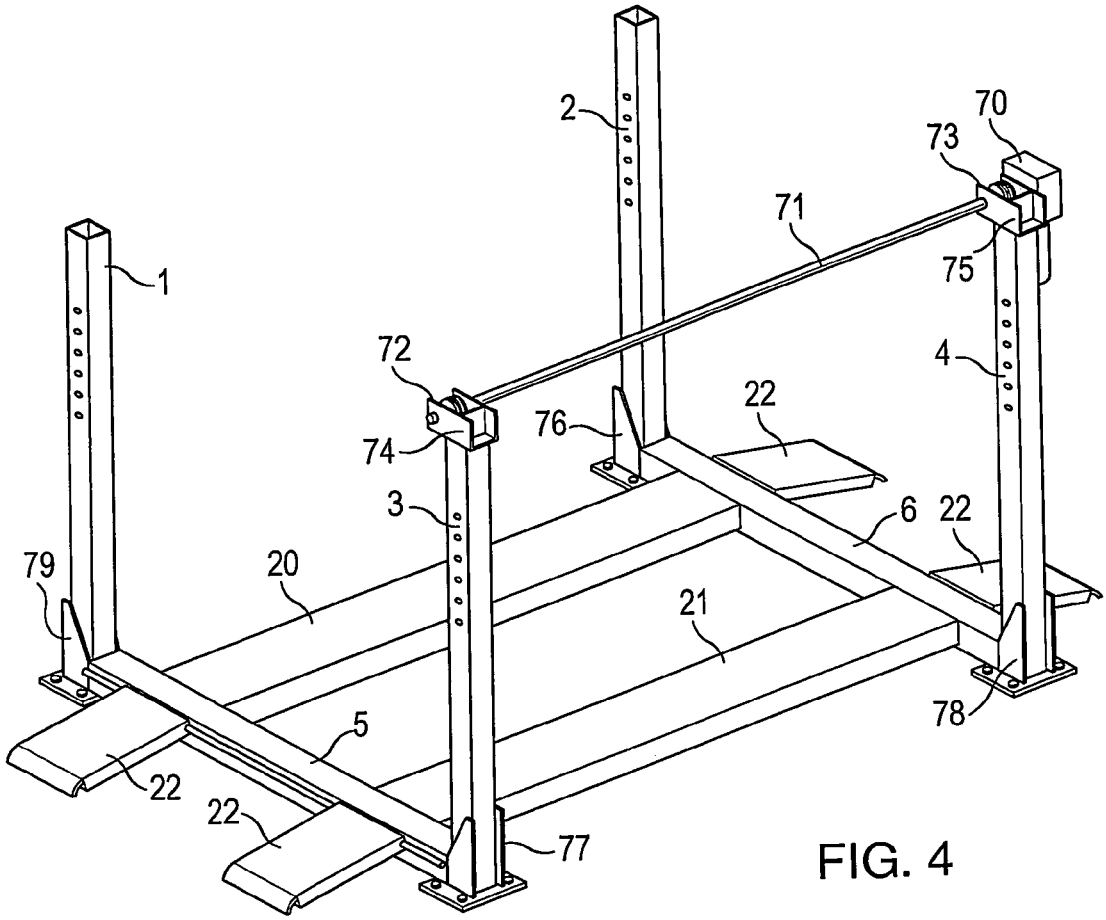
FIG. 4 shows the schematic overall view of another embodiment of a four post parking platform according to the invention.

The essential difference of the parking platform according to FIG. 4 in contrast to the embodiment of FIG. 1 lies in the arrangement of the drive assembly 70 which in this parking platform according to FIG. 4 is fixedly mounted to the upper end of the post 4 and drives an upper shaft 71. The shaft 71 extents on a lateral side between a front and a rear post 3, 4 and is rotatably mounted to mounting arrangements 72, 73 at the upper end part 74, 75 of these two posts 3, 4. The right shaft end in FIG. 4 is connected to the driven element of the drive assembly 70 advantageously formed as a drive motor. In this embodiment according to FIG. 4 the supporting frame construction constituted by the two wide platform tracks 20, 21 and the two transverse members 5, 6 is lifted and lowered by tractions cords, in particular by traction belts or also by traction ropes which are wound and unwound on winches, drums or spools in a suitable manner. During the lifting und lowering movements the supporting frame construction 5, 6; 20, 21 is guided on the posts 1 to 4 by guide shoes 76 to 79 a respective one of which is attached to an end part of the transverse members 5 and 6. Each guide shoe encompasses the related post on three sides on the outside. An exact guide low in friction and free from wear as far as possible of the transverse members 5, 6 is achieved by providing gliding and rolling elements, respectively, in each guide shoe. Slide blocks provided on several surfaces that are aligned at right angles towards each other may be used as gliding elements and cylindrical or conical runners may be used as rolling elements.

Figure 5:
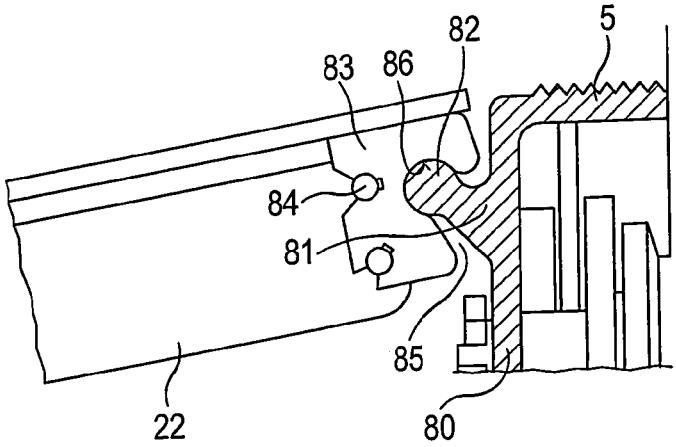
FIG. 5 shows the enlarged view of the installation of a ramp to a transverse member.

FIG. 5 shows a particular linkage of a ramp 22 to a transverse member 5. In the parking platform of FIG. 5 the transverse member 5 consists of an extrusion molded hollow profile made from a light metal, preferably an aluminum material of sufficient stability. On the one side wall 80 of the transverse member 5 shown in a partial cross-section a longitudinal rail 81 obliquely pointing upwards is formed to which an integral spheroidal end part 82 is joined. At the end of the ramp 22 a holder 83 is attached by screws 84. The ramps 22 may also be manufactured of light metal profiles or as light metal cast parts such that the screws 84 represent the preferred means of connection. If the ramps 22 are formed from flat steel blanks or made from cast iron, welding connections may be chosen instead of screw connections. A cutout 85 is formed in the holder 83, which in FIG. 5 opens downwards to the right and has a circular part 86. The longitudinal rail 81 formed to the transverse member 5 meshes with the cutout 85. The shape and size of the spheroidal end part 82 is closely adapted to the circular part 86 of the cutout 85 such that pivoting movements of the ramp 22 about the center axis of the spheroidal end part 82 are possible and due to a constriction it is not possible that the spheroidal end part 82 slips out of the circular part 86 of the cutout 85. The linkage of the ramp 22 to the respective transverse member 5 is fast and simple. For this purpose, the respective ramp 22 merely needs to be pushed laterally onto the rail 81 with the cutout 85 of its holder 83.

The invention is not limited to the embodiments and details as shown and described. Thus, features shown and/or described in an embodiment may also be applied to other embodiments in the frame of the invention. For example, this applies to the materials of the supporting constructional elements, such as posts, platform tracks, supports, which may be individually or completely be formed of light metal, preferably as an extruded profile or as a shaped flat steel construction.

We claim:

1. A four post parking platform for motor vehicles, comprising two longitudinally directed platform tracks for receiving a vehicle, a front and rear transverse member which both are guided on their ends at posts in a vertically displaceable manner, flexible traction cords which are provided for engaging the front and rear transverse members for raising and lowering the platform tracks and can be wound and unwound on at least two spool bodies, a torsionally rigid shaft for connecting the at least two spool bodies to each other, and an electrical drive assembly as a rotary drive for the at least two spool bodies and the shaft, wherein the drive assembly is mounted to one of the front and rear transverse members that can be raised and lowered vertically, the shaft is aligned parallel to the platform tracks and rotatably mounted to the front and rear transverse members and an end of at least one of the flexible traction cords is fixed to an upper end of one of the posts.

2. The parking platform according to claim 1, wherein a guide acting multilaterally on at least one of the posts and a deflection pulley for the at least one of the flexible traction cords are provided at each end of the front and rear transverse members.

3. The parking platform according to claim 1, wherein the posts have a square cross section and the front and rear transverse members are guided via tapered pulleys at the posts.

4. The parking platform according to claim 1, wherein releasable locking mechanisms for fixing the front and rear transverse members in a lifted parking position are provided at the upper ends of the posts.

5. The parking platform according to claim 1, wherein locking mechanisms on at least one of the posts contain profile plates mounted in a rotatable manner on which the front and rear transverse members in a parking position are supported by means of a respective parking element on the ends of the front and rear transverse members.

6. The parking platform according to claim 5, wherein the profile plates have an indentation on a front side and are mounted in a rotatable manner at both sides at the upper sends of the posts to be rotatable within predetermined angular ranges.

7. The parking platform according to claim 1, wherein the flexible traction cords are broad flat belts made of high-tensile materials.

8. The parking platform according to claim 1, wherein to each of the front and rear transverse members at least one of the spool bodies is mounted, the shaft connecting the two spool bodies is coupled to the drive assembly, and the drive assembly is mounted to the rear transverse member.

9. The parking platform according to claim 1, wherein an automatically responding security system is provided for monitoring the at least one of the flexible traction cords for rupture and slack.

10. The parking platform according to claim 9, wherein the security system has prestressed clamping elements which are mounted to the transverse members and in case of rupture or slack of the at least one of the flexible traction cords get into firm clamping engagement with a wall of at least one of the posts.

11. The parking platform according to claim 9, wherein the security system has two respective rocker plates held rotatably about a bolt between lateral rails of the front and rear transverse members, and between which a deflection pulley for the at least one of the flexible traction cords is supported in a freely rotatable manner, at least one rocker plate having cam surfaces which get into clamping engagement with a wall of at least one of the posts in case of rupture or slack of the at least one of the flexible traction cords.

12. The parking platform according to claim 1, wherein the posts, the front and rear transverse members and the platform tracks are partly or completely made from light metal profiles.

* * * * *